US007366432B2

(12) United States Patent
Kishi et al.

(10) Patent No.: US 7,366,432 B2
(45) Date of Patent: Apr. 29, 2008

(54) FIXING DEVICE FOR FIXING AN IMAGE, IMAGE FORMING APPARATUS INCLUDING THE FIXING DEVICE, AND FIXING METHOD

(75) Inventors: Kazuhito Kishi, Yokohama (JP); Susumu Matsusaka, Yokohama (JP); Yasuhisa Kato, Hiratsuka (JP); Akiyasu Amita, Yokohama (JP); Masami Okamoto, Yamato (JP); Yasutada Tsukioka, Matsudo (JP); Hiromasa Takagi, Tokyo (JP); Ryuichi Kikegawa, Miyagi-ken (JP)

(73) Assignee: Ricoh Company, Ltd., Tokyo (JP)

( * ) Notice: Subject to any disclaimer, the term of this patent is extended or adjusted under 35 U.S.C. 154(b) by 323 days.

(21) Appl. No.: 11/220,621

(22) Filed: Sep. 8, 2005

(65) Prior Publication Data

US 2006/0051113 A1 Mar. 9, 2006

(30) Foreign Application Priority Data

Sep. 8, 2004 (JP) ..... 2004-261701

(51) Int. Cl.
*G03G 15/00* (2006.01)
*G03G 15/20* (2006.01)

(52) U.S. Cl. ..... 399/44; 399/67; 399/69; 399/88

(58) Field of Classification Search ..... 399/44, 399/67, 69, 70, 88, 328, 334; 219/216
See application file for complete search history.

(56) References Cited

U.S. PATENT DOCUMENTS 4,843,214 A 6/1989 Higashi et al.
5,481,350 A 1/1996 Yasui et al.
5,729,798 A 3/1998 Yasui et al.
5,745,247 A 4/1998 Yasui et al.

(Continued)

FOREIGN PATENT DOCUMENTS

JP 2002-082570 3/2002

(Continued)

OTHER PUBLICATIONS

U.S. Appl. No. 11/047,686, filed Feb. 2, 2005, Kishi et al.

(Continued)

*Primary Examiner*—William J. Royer
(74) *Attorney, Agent, or Firm*—Oblon, Spivak, McClelland, Maier & Neustadt, P.C.

(57) ABSTRACT

A fixing device for fixing an image formed on a recording material includes a fixing member and a pressing member which are rotatable to pass the recording material having an image through their nip part, a heating part that heats the fixing member, a storage unit that is charged by an external power source to supply power to the heating part, and a control unit that controls the external power source and the storage unit to supply power to the heating part without rotating the fixing member and pressing member at a time of warming-up the fixing member by the heating part in a first case. The control unit further controls the external power source to supply power to the heating part and controls the storage unit so as not to supply power to the heating part while rotating the fixing member and the pressing member in a second case.

18 Claims, 10 Drawing Sheets

U.S. PATENT DOCUMENTS

| | | | | |
|---|---|---|---|---|
| 5,854,465 | A | 12/1998 | Kishi et al. | |
| 6,144,832 | A | 11/2000 | Nimura et al. | |
| 6,542,705 | B2 | 4/2003 | Fujita et al. | |
| 6,813,464 | B2 | 11/2004 | Amita et al. | |
| 6,941,088 | B2 * | 9/2005 | Atsushi et al. | 399/69 |
| 7,127,189 | B2 * | 10/2006 | Takamatsu et al. | 399/69 |
| 7,164,870 | B2 * | 1/2007 | Satoh | 399/69 |
| 7,212,758 | B2 * | 5/2007 | Kishi et al. | 399/67 |
| 7,236,714 | B2 * | 6/2007 | Sato et al. | 399/70 |
| 7,239,821 | B2 * | 7/2007 | Matsusaka et al. | 399/69 |
| 7,247,816 | B2 * | 7/2007 | Kishi et al. | 219/216 |
| 7,254,353 | B2 * | 8/2007 | Koyama et al. | 399/69 |
| 7,260,337 | B2 * | 8/2007 | Koyama et al. | 399/67 |
| 2004/0022552 | A1 | 2/2004 | Yura et al. | |
| 2004/0149740 | A1 | 8/2004 | Kishi et al. | |
| 2004/0179875 | A1 | 9/2004 | Iwata et al. | |
| 2004/0202490 | A1 | 10/2004 | Okamoto | |
| 2004/0245235 | A1 | 12/2004 | Kishi et al. | |
| 2004/0245241 | A1 | 12/2004 | Kishi et al. | |
| 2004/0247332 | A1 | 12/2004 | Kishi et al. | |
| 2004/0258426 | A1 | 12/2004 | Kishi et al. | |
| 2005/0074251 | A1 | 4/2005 | Katoh et al. | |
| 2005/0123315 | A1 | 6/2005 | Kishi et al. | |
| 2005/0139584 | A1 | 6/2005 | Kishi et al. | |
| 2005/0175370 | A1 | 8/2005 | Matsusaka et al. | |

FOREIGN PATENT DOCUMENTS

| | | |
|---|---|---|
| JP | 2002-184554 | 6/2002 |

OTHER PUBLICATIONS

U.S. Appl. No. 11/405,448, filed Apr. 18, 2006, Kishi et al.
U.S. Appl. No. 11/522,324, filed Sep. 18, 2006, Semma et al.
U.S. Appl. No. 11/582,991, filed Oct. 19, 2006, Kishi et al.
U.S. Appl. No. 11/554,944, filed Oct. 31, 2006, Yano et al.
U.S. Appl. No. 11/609,467, filed Dec. 12, 2006, Kishi et al.
U.S. Appl. No. 11/678,854, filed Feb. 26, 2007, Yano et al.

* cited by examiner (1): SUPPLYING POWER TO HEATING PART
(2): SUPPLYING POWER TO AUX. POWER SUPPLY UNIT
(3): SUPPLYING POWER TO HEATING PART
(4): CHARGED (1): SUPPLYING POWER TO HEATING PART
(2): SUPPLYING POWER TO AUX. POWER SUPPLY UNIT
(3): SUPPLYING POWER TO HEATING PART
(4): CHARGED

FIXING DEVICE FOR FIXING AN IMAGE, IMAGE FORMING APPARATUS INCLUDING THE FIXING DEVICE, AND FIXING METHOD

CROSS-REFERENCE TO RELATED APPLICATIONS

This application claims priority to Japanese Patent Application No. 2004-261701 filed in the Japanese Patent Office on Sep. 8, 2004, the entire contents of which is herein incorporated by reference.

BACKGROUND OF THE INVENTION

1. Field of the Invention

The present invention relates to a fixing device and a fixing method in which an image is fixed onto a recording material while supplying power to a heating part of a fixing roller from a storage unit.

2. Discussion of the Related Art

A fixing device that fixes a toner image formed on a recording material such as a recording sheet, via a heating part having a main heating element and an auxiliary heating element has been widely used. In such a conventional fixing device, the main heating element is powered by a main power supply unit, and the auxiliary heating element is powered by an auxiliary power supply unit including a capacitor. When the heating part starts to generate heat, the amount of power supplied from the capacitor to the auxiliary heating element is adjusted based on the temperature of the heating part.

Published Japanese patent application No. 2002-184554 describes the above fixing device. In the fixing device, the heating part is rapidly warmed-up to a predetermined temperature by being supplied with a large amount of power from both the main power supply unit and the auxiliary power supply unit. During a stand-by state of the fixing device, the main power supply unit and the auxiliary power supply unit do not supply power to the heating part. Thus, the power-saving effect is enhanced, and the noise caused by a sudden current change or an in-rush current at the time of starting or stopping the supply of high power is reduced. Further, a warm-up time of the heating part is reduced, and the heating part is prevented from overheating. The fixing device further includes a charger, a switching unit, a temperature detecting unit, and a control unit. The charger charges the capacitor of the auxiliary power supply unit with power supplied from the main power supply unit. The switching unit performs switching between the charger of the auxiliary power supply unit and the supply of power from the auxiliary power supply unit to the auxiliary heating element. The temperature detecting unit detects the temperature of the heating part. The control unit controls the amount of power supplied from the auxiliary power supply unit to the auxiliary heating element based on the temperature of the heating part detected by the temperature detecting unit.

In another known fixing device including a fixing member and a pressing member disposed opposite to the fixing member, a toner image formed on a recording material is fixed by heat and pressure while the recording material passes through a nip part between the fixing member and the pressing member. At a startup period of the fixing device during which the fixing member is heated until the temperature of the fixing member reaches a target temperature, the fixing member and the pressing member are pre-rotated to make the temperatures of these members uniform before starting a fixing operation of a toner image. For example, Published Japanese patent application No. 2002-82570 describes a fixing device in which a fixing member and a pressing member are pre-rotated.

In a fixing device using a main power supply unit and an auxiliary power supply unit including a capacitor that supplies power to a heating part, it is desirable to efficiently save the power supplied to the heating part from the auxiliary power supply unit and to enhance a quality of an image fixed on a recording material even if the fixing device is in a low temperature condition.

SUMMARY OF THE INVENTION

According to an aspect of the present invention, a fixing device for fixing an image formed on a recording material includes a fixing member, a heating part configured to heat the fixing member, and a pressing member configured to press-contact the fixing member. The fixing member and the pressing member are rotatable to pass the recording material having an image through a nip part formed between the fixing member and the pressing member, to thereby fix the image onto the recording material by heat and pressure. The fixing device further includes a storage unit configured to be charged by an external power source to supply power to the heating part, and a control unit configured to control the external power source to supply power to the heating part and to determine whether to start to supply power to the heating part from the storage unit. The control unit is configured to select one of a first case and a second case at a time of warming-up the fixing member by the heating part. The control unit is configured to control the external power source and the storage unit to supply power to the heating part without rotating the fixing member and the pressing member in the first case, and the control unit is configured to control the external power source to supply power to the heating part and to control the storage unit so as not to supply power to the heating part while rotating the fixing member and the pressing member in the second case.

According to another aspect of the present invention, an image forming apparatus includes an image forming device configured to form an image on a recording material, and the above-described fixing device.

According to yet another aspect of the present invention, the method of fixing an image formed on a recording material includes charging a storage unit by an external power source; supplying power to a heating part from the storage unit; heating a fixing member by the heating part; controlling the external power source and the storage unit to supply power to the heating part without rotating the fixing member and a pressing member at a time of warming-up the fixing member by the heating part in a first case; and controlling the external power source to supply power to the heating part and controlling the storage unit so as not to supply power to the heating part while rotating the fixing member and the pressing member at the time of warming-up the fixing member by the heating part in a second case.

BRIEF DESCRIPTION OF THE DRAWINGS

A more complete appreciation of the present invention and many of the attendant advantages thereof will be readily obtained as the same becomes better understood by reference to the following detailed description of non-limiting embodiments when considered in connection with the accompanying drawings, wherein.

DESCRIPTION OF THE PREFERRED EMBODIMENTS

Figure 1:
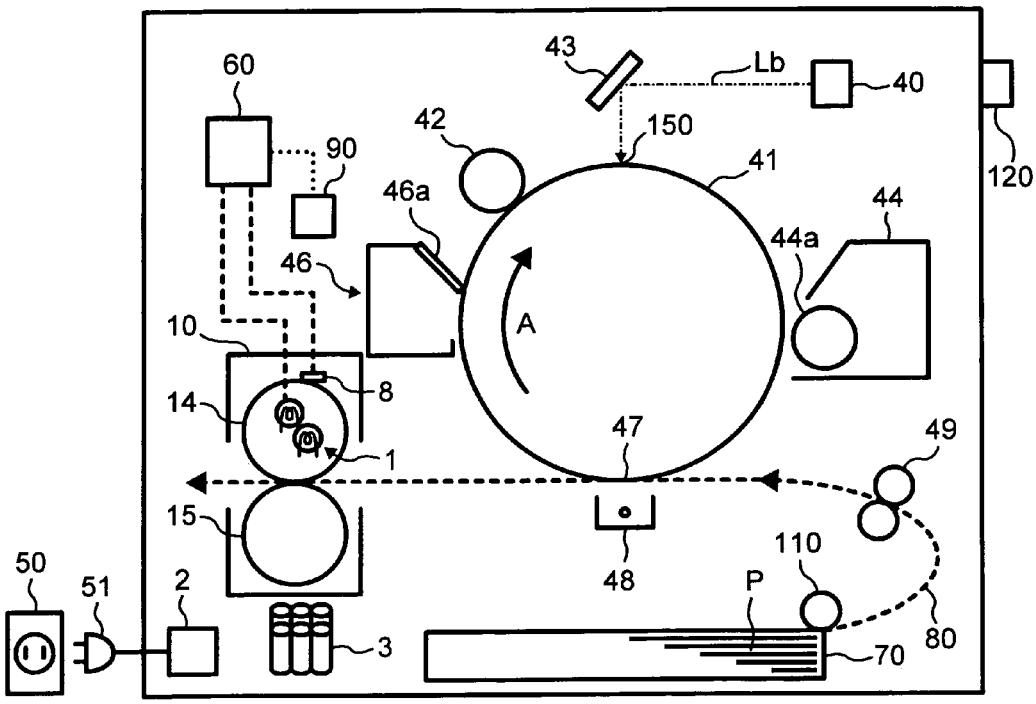
FIG. 1 is a schematic cross sectional view of an image forming apparatus including a fixing device according to an embodiment of the present invention.

Non-limiting embodiments of the present invention are now described with reference to the drawings, wherein like reference numerals designate identical or corresponding parts throughout the several views.

FIG. 1 is a schematic cross sectional view of an image forming apparatus including a fixing device according to an embodiment of the present invention. The image forming apparatus may be a copying machine, a printer, a facsimile machine, or other similar image forming apparatuses. The image forming apparatus includes a drum-shaped photoreceptor 41 acting as an image carrier. Arranged around the photoreceptor 41 are a charging device 42, a mirror 43, a developing device 44, a transfer device 48, and a cleaning device 46 in the order of the rotational direction of the photoreceptor 41 indicated by an arrow A in FIG. 1. Specifically, the charging device 42 includes a charging roller. The mirror 43 constitutes a part of an exposure device 40. The developing device 44 includes a developing roller 44*a*. The transfer device 48 transfers a developed image to a recording material P such as a transfer sheet. The cleaning device 46 includes a blade 46*a* being in sliding-contact with the circumferential surface of the photoreceptor 41. Reference numeral 150 in FIG. 1 indicates an exposure portion of the circumferential surface of the photoreceptor 41 located between the charging device 42 and the developing roller 44*a*. The exposure portion 150 is exposed to a laser light beam Lb emitted from the exposure device 40 and reflected by the mirror 43.

The transfer device 48 is disposed opposite to the lower circumferential surface of the photoreceptor 41. Reference numeral 47 in FIG. 1 indicates a transfer section where the transfer device 48 faces the photoreceptor 41. Further, a pair of registration rollers 49 are provided on an upstream side of the transfer section 47 in the rotational direction of the photoreceptor 41. The recording material P is fed out from a sheet feeding cassette 70, by a sheet feeding roller 110, toward the registration rollers 49 while being guided by a sheet conveyance guide plate (not shown). Moreover, a fixing device 10 is disposed on a downstream side of the transfer section 47 in the rotational direction of the photoreceptor 41.

The image forming operation of the image forming apparatus is performed as follows. First, the charging device 42 uniformly charges the rotating photoreceptor 41. Then, the exposure device 40 emits the laser light beam Lb corresponding to image data to the exposure portion 150 of the circumferential surface of the photoreceptor 41, thereby writing a latent image on the surface of the photoreceptor 41. The latent image moves to the developing device 44 by the rotation of the photoreceptor 41, and is developed with toner by the developing device 44. As a result, a toner image is formed on the surface of the photoreceptor 41.

The recording material P, which has been fed out from the sheet feeding cassette 70 by the sheet feeding roller 110, is conveyed through a sheet conveyance path 80 (indicated by dotted lines in FIG. 1) to the registration rollers 49 and stops at a nip part between the registration rollers 49. Then, the registration rollers 49 feed the recording material P toward the transfer section 47 at an appropriate timing, so that the recording material P is aligned with the toner image on the photoreceptor 41. Subsequently, the toner image is transferred from the surface of the photoreceptor 41 onto the surface of the recording material P under the influence of a transfer electric field produced in the transfer section 47 by the transfer device 48. In the above-described image forming apparatus, for example, the exposure device 40, the photoreceptor 41, the charging device 42, the developing device 44, and the transfer device 48 act as an image forming device that forms a toner image on the recording material P. The recording material P having a transferred toner image is conveyed through the sheet conveyance path 80 to the fixing device 10. The fixing device 10 fixes the toner image onto the recording material P by the application of heat and pressure while the recording material P passes through the sheet conveyance path 80 in the fixing device 10. The recording material P having a fixed toner image is discharged to a sheet discharging section (not shown) of the image forming apparatus.

The residual toner which has not been transferred from the photoreceptor 41 to the recording material P is moved to the cleaning device 46 by the rotation of the photoreceptor 41, and is removed from the surface of the photoreceptor 41 by the blade 46*a*. Subsequently, the charging device 42 uniformly charges the surface of the photoreceptor 41 to prepare for a next image forming operation. Reference numeral 120 in FIG. 1 indicates a power switch that turns on and off power to the image forming apparatus.

Figure 2:
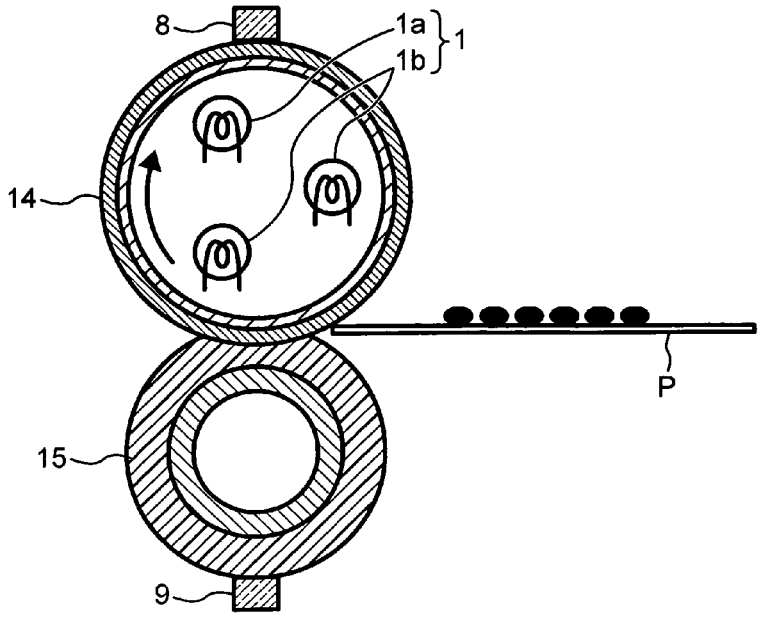
FIG. 2 is a schematic cross sectional view of the fixing device according to an embodiment of the present invention.

FIG. 2 is a schematic cross sectional view of the fixing device 10 according to an embodiment of the present invention. As illustrated in FIG. 2, the fixing device 10 includes a fixing member such as a fixing roller 14 and a pressing member such as a pressing roller 15. The fixing roller 14 has a hollow cylindrical base. In view of durability and the possible deformation caused by pressure, the base of the fixing roller 14 is preferably formed from a metallic material, such as aluminum, or iron, for example. Further, it is preferable that the circumferential surface of the fixing roller 14 include a releasing layer covering the circumference of the base to prevent toner from being adhered onto the surface of the fixing roller 14. Moreover, the inner circumferential surface of the fixing roller 14 may be blackened to efficiently absorb the heat of heating members 1*a* and 1*b* (described below).

The pressing roller 15 includes a metal core and an elastic layer made of rubber or the like overlying the metal core. The pressing roller 15 is press-contacted against the fixing roller 14 with a predetermined pressing force by a pressing device (not shown). While the recording material P passes through a nip part between the fixing roller 14 and the pressing roller 15, a toner image is fixed onto the recording material P under the influence of heat and pressure. The pressing roller 15 may include a foamed layer overlying the a metal core. In this case, because the heat of the fixing roller 14 does not tend to be transferred to the pressing roller 15 due to the insulation effectiveness of the foamed layer of the pressing roller 15, the fixing roller 14 can be quickly heated up. The fixing device 10 of the present embodiment uses the fixing roller 14 as the fixing member and the pressing roller 15 as the pressing member. Alternatively, the fixing device 10 may use an endless belt or film for at least one of the fixing member and the pressing member.

The fixing device 10 further includes a heating part 1 having an AC heating element 1*a* (hereafter referred to as a main heating member 1*a*) and DC heating elements 1*b* (hereafter referred to as auxiliary heating members 1*b*). As a non-limiting example, the heating part 1 includes one main heating member 1*a* and two auxiliary heating members 1*b*. The main heating member 1*a* and auxiliary heating members 1*b* may be disposed at any desired position where the main heating member 1*a* and the auxiliary heating members 1*b* heat the fixing roller 14. In this embodiment, the main heating member 1*a* and auxiliary heating members 1*b* are disposed in the fixing roller 14 to heat the fixing roller 14 from inside. The fixing device 10 of FIG. 2 has a construction wherein the fixing roller 14 acts as a heat roller heated by a radiation heater from inside and also acts as a sheet conveyance roller disposed on the sheet conveyance path 80.

With reference to FIGS. 1 and 2, the fixing device 10 further includes a fixing temperature detecting unit 8, a local ambient temperature detecting unit 90, and a control unit 60. The fixing temperature detecting unit 8 may be formed by any temperature detecting unit capable of detecting the surface temperature of the fixing roller 14, and the temperature detecting unit does not need to make direct contact with the outer circumferential surface of the fixing roller 14 as long as it can detect the surface temperature of the fixing roller 14. Therefore, various contact type sensors and non-contact type sensors, including a thermistor, a thermocouple, an infrared temperature detector, or the like, may be used for the fixing temperature detecting unit 8. The fixing temperature detecting unit 8 transmits data of temperature information to the control unit 60. The local ambient temperature detecting unit 90 detects a local ambient temperature in the vicinity of the fixing roller 14. A thermistor, a thermocouple, or the like may be used for the local ambient temperature detecting unit 90. The local ambient temperature detecting unit 90 also transmits data of temperature information to the control unit 60. The control unit 60 controls the start of the power supply, stopping of the power supply, and an increase or decrease in the amount of power supplied to the heating part 1 of the fixing device 10, based on temperature information obtained by the fixing temperature detecting unit 8 and the local ambient temperature detecting unit 90.

Figure 3:
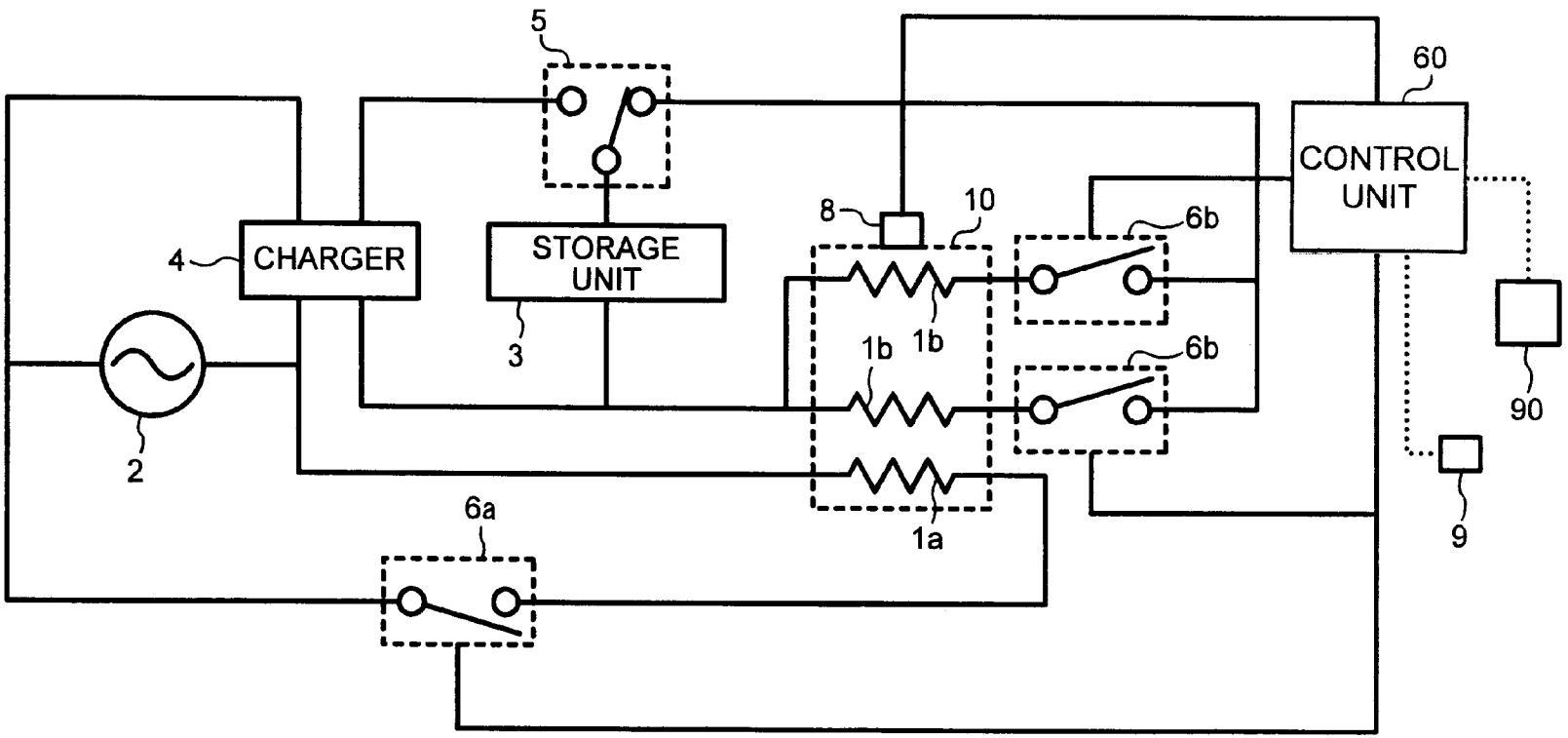
FIG. 3 is a block diagram of an exemplary power supply control circuit structure of the fixing device according to an embodiment of the present invention.

FIG. 3 is a block diagram of an exemplary control circuit structure of the fixing device 10 according to an embodiment of the present invention. In FIG. 3, only a circuit portion involved in power supply to the heating part 1 is illustrated. With reference to FIG. 3, the power supply control circuit of the fixing device 10 includes a main power supply unit 2, a storage unit 3 acting as an auxiliary power supply unit, a charger 4, a charge/discharge switching unit 5, a main switching element 6*a*, auxiliary switching elements 6*b*, and the control unit 60.

The main power supply unit 2 is powered by an external power source such as a commercial power source to feed electric power to each unit of the image forming apparatus when the power switch 120 of the image forming apparatus is turned on. The main power supply unit 2 is configured to feed electric power to each unit of the image forming apparatus by being connected to an outlet 50 of the commercial power source via a plug 51 (shown in FIG. 1). In Japan, the commercial power source is limited to about 100V and 15 A, and the maximum power of the main power supply unit 2 is generally set to about 1500 W. The main power supply unit 2 may have the functions of adjusting the voltage, commutating an alternating current and a direct current, and stabilizing the voltage. The main heating member 1*a* heats by being supplied with power from the main power supply unit 2.

The storage unit 3 acting as an auxiliary power supply unit is formed from an electric double layer capacitor, and is powered by the main power supply unit 2 to supply power to the auxiliary heating members 1*b*. That is, each of the auxiliary heating members 1*b* is heated via power from the storage unit 3. Instead of the electric double layer capacitor, the storage unit 3 may be formed from a lithium-ion secondary battery, a nickel metal hydride secondary battery, or a pseudocapacitor using redox.

As illustrated in FIG. 3, the storage unit 3 is connected to the charger 4, and the charger 4 is connected to the main power supply unit 2. The charger 4 is configured to subject the power supplied from the main power supply unit 2 to a voltage adjustment and an AC/DC conversion, and to supply the power to the storage unit 3. The storage unit 3 supplies the stored power (auxiliary power) to the auxiliary heating members 1*b* via the charge/discharge switching unit 5. The charge/discharge switching unit 5 selectively allows one of the supplying of power from the storage unit 3 to the auxiliary heating members 1*b* and the charging of the storage unit 3 by the charger 4. The control unit 60 controls the main switching element 6*a* to switch ON and OFF the power supply from the main power supply unit 2 to the main heating member 1*a*, and controls the auxiliary switching elements 6*b* to switch ON and OFF the power supply from the storage unit 3 to the auxiliary heating members 1*b*.

As a non-limiting example, the storage unit 3 is formed by a capacitor module made up of a plurality (for example, forty) of electric double-layer capacitor cells connected in series. Each capacitor cell may have a capacitance of approximately 800 F at a rated voltage of 2.5 V, so as to realize a high output voltage of approximately 100V from the capacitor module. Each capacitor cell may have an internal resistance of about 5 mΩ or less, a diameter of about 35 mm, and a length of about 120 mm. Stable operation of the storage unit 3 can be achieved for a long period of time by providing a voltage balance circuit (not shown) to keep a voltage balance among capacitor cells connected in series. If the internal resistance of each capacitor cell is set to about 5 mΩ or less, the decrease of the voltage between terminals of the storage unit 3 can be less than that of the secondary battery, such as a lithium-ion battery, and a nickel metal hydride battery, even if a large electric current over 20 A flows to the auxiliary heating members 1*b* at the time of warming-up the fixing roller 14. Further, as a large amount of electric power can be obtained from relatively small number of capacitor cells, the cost and size of the storage unit 3 can be decreased.

The storage unit 3 is chargeable and dischargeable. Because the storage unit 3 uses an electric double-layer capacitor which has a large capacity and is not accompanied by chemical reactions, the storage unit 3 can be rapidly charged and its useful lifetime is longer than a secondary battery. In the case of using a nickel-cadmium battery as an auxiliary power supply, which is generally used as a secondary battery, several tens of minutes to several hours may be necessary for charging the nickel-cadmium battery, even if boosting charge is performed. For this reason, a large power can be supplied to units of an apparatus only several times a day, so that the use of the nickel-cadmium battery as an auxiliary power supply is not practical. In contrast, the storage unit 3 using an ultra capacitor can be charged in about several tens of seconds to several minutes. Thus, the time for charging the storage unit 3 can be lessened. For example, the storage unit 3 using an ultra capacitor can be charged when the main power supply unit 2 charges the storage unit 3 during a non-image forming state of the image forming apparatus. Thus, the number of heating operations by using the storage unit 3 as the auxiliary power supply unit can be increased to a practical number.

The useful lifetime of the nickel-cadmium battery is short because the number of allowable charge-discharge iteration times of the nickel-cadmium battery is about 500 to 1000 times. Accordingly, it may be necessary to replace the nickel-cadmium battery very frequently, thereby resulting in the corresponding replacement task and increasing costs for battery replacement. In contrast, the number of allowable charge-discharge iteration times of the capacitor is about 10,000 times or more. Further, the capacitor is not easily deteriorated, even if the capacitor is charged and discharged repeatedly. Maintenance of the capacitor is rarely required because the capacitor does not need any liquid exchange or supplement otherwise used in a lead-acid battery.

A capacitor which can store a large amount of electric energy has been developed, so that the use of the capacitor in an electric car is under review. For example, the electric double-layer capacitor developed by Nippon Chemicon Co. has an electrostatic capacitance of about 2000 F at a rated voltage of 2.5 V, which is sufficient for power supply for several seconds to several ten seconds. Further, a capacitor named HYPER CAPACITOR (trade name) manufactured by NEC Corp. has an electrostatic capacitance of about 80 F. Moreover, JEOL Ltd. discloses a NANOGATE CAPACITOR (trade name) which has a voltage proof of about 3.2 to 3.5V and an electric energy density of about 50 to 75 wh/kg.

The main heating member 1*a* and the auxiliary heating members 1*b* may be formed from halogen heaters. The halogen heater heats by flowing electric current through a filament formed in a glass tube. Instead of the halogen heater or halogen lamp, the main heating member 1*a* and the auxiliary heating members 1*b* may be formed from induction heaters or ceramic heaters. For example, the main heating member 1*a*, which is powered by the main power supply unit 2, may be formed from a halogen heater which can provide a 1200 W output at the voltage of 100V. For example, the auxiliary heating members 1*b*, which are powered by the storage unit 3, may be formed from two halogen heaters connected in parallel. One of the halogen heaters can provide a 1000 W output at the voltage of 100V, and the other halogen heater can provide a 700 W output at the voltage of 100V, for example.

As described above, the heating part 1 of the fixing roller 14 receives power such that the main heating member 1*a* is supplied with power from the main power supply unit 2 and the auxiliary heating members 1*b* are supplied with power from the storage unit 3. The power from the main power supply unit 2 is supplied to the storage unit 3 through the charger 4, and the storage unit 3 supplies stored power to the auxiliary heating members 1*b* at an arbitrary timing.

Figure 4A:
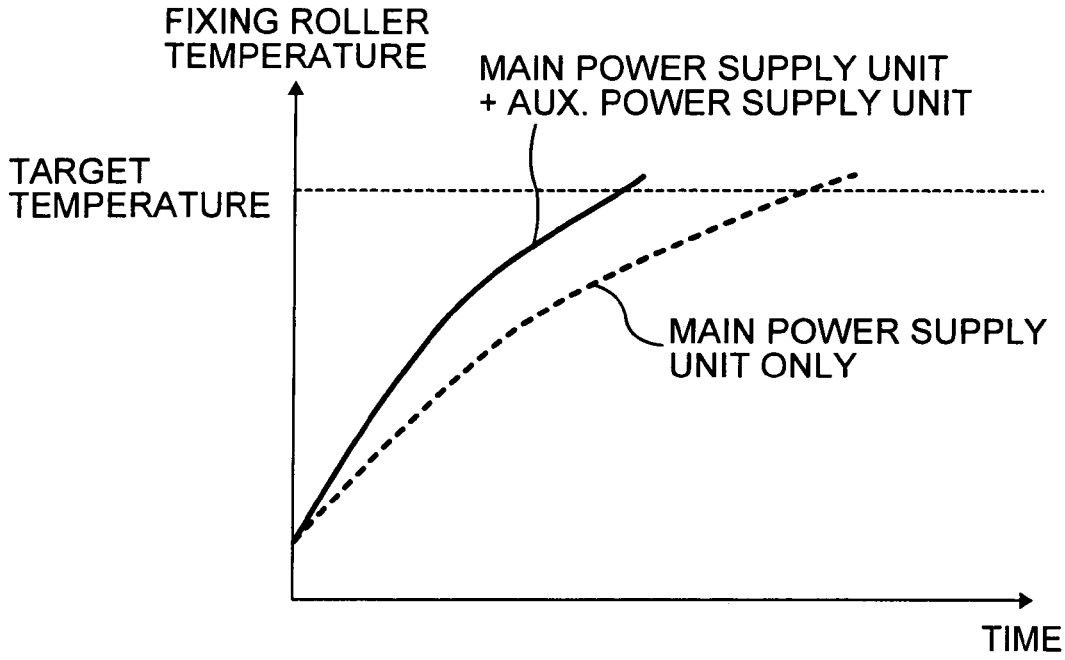
FIG. 4A is a graph showing the variation of a temperature of a fixing roller with time at the time of warming-up the fixing roller according to an embodiment of the present invention.

FIG. 4A is a graph showing the variation of the temperature of the fixing roller 14 with time when warming-up the fixing roller 14 according to an embodiment of the present invention. By supplying power from the storage unit 3 to the heating part 1, in addition to the power supplied from the main power supply unit 2 to the heating part 1, an amount of power greater than the amount of power supplied by the main power supply unit 2 can be supplied to the heating part 1 of the fixing roller 14. Therefore, the warm-up time for raising the temperature of the fixing roller 14 from a room temperature to a target temperature can be decreased by heating the heating part 1 with both the main power supply unit 2, and the storage unit 3 instead of by heating the heating part 1 with only the main power supply unit 2 as illustrated in the graph of FIG. 4A.

Figure 4B:
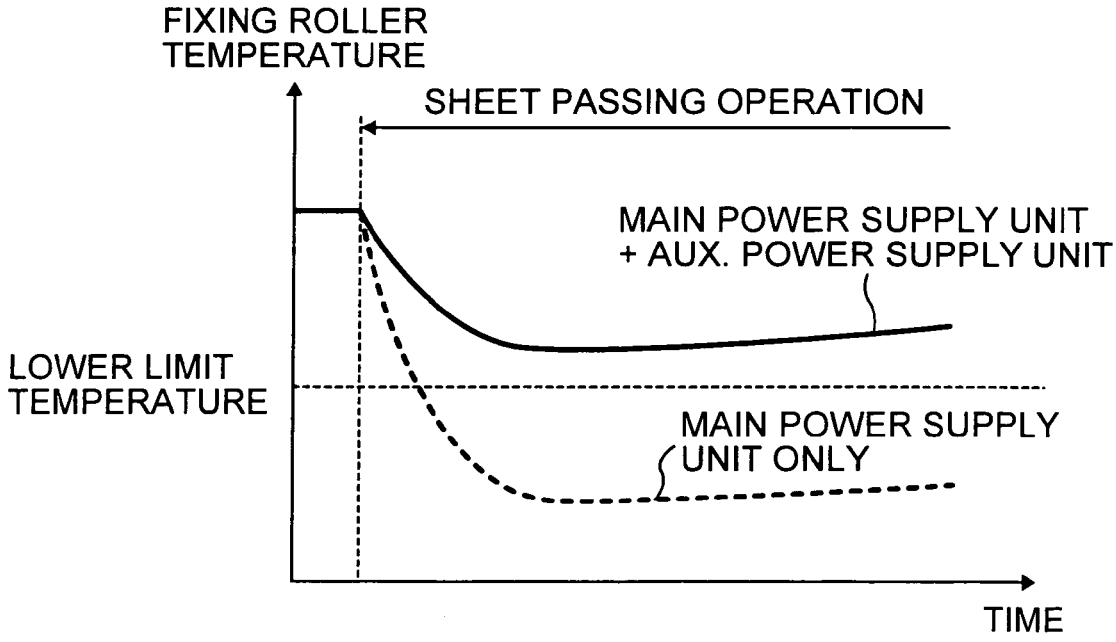
FIG. 4B is a graph showing the variation of the temperature of the fixing roller with time during a sheet passing operation according to an embodiment of the present invention.

FIG. 4B is a graph showing a variation of the temperature of the fixing roller 14 with time during a sheet passing operation according to an embodiment of the present invention. If a plurality of the recording materials P pass through the fixing device 10 consecutively (i.e., a sheet passing operation), the recording material P absorbs heat from the fixing roller 14. In this condition, if the heating part 1 is supplied with power from only the main power supply unit 2, the temperature of the fixing roller 14 falls below a predetermined lower limit temperature as illustrated in FIG. 4B. In contrast, by supplying power to the heating part 1 from both the main power supply unit 2 and the storage unit 3, the drop in temperature of the fixing roller 14 can be controlled as illustrated in FIG. 4B. By this control, the number of recording materials P passing through the fixing device 10 per unit time can be increased, allowing the image forming apparatus to make copies or prints at a high speed.

Figure 5:
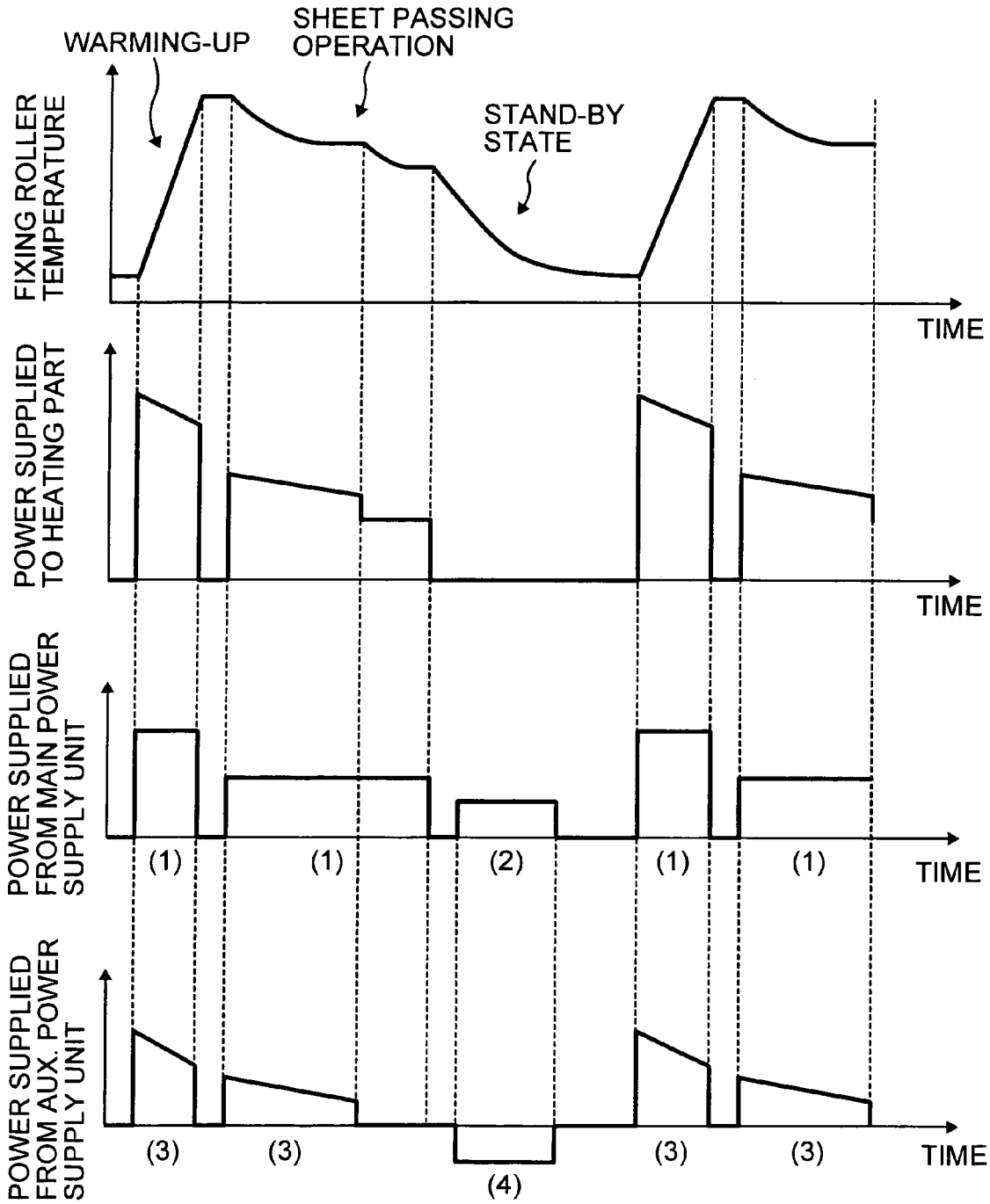
FIG. 5 is a time chart for explaining a power supply operation of the fixing device according to an embodiment of the present invention.

FIG. 5 is a time chart for explaining a power supply operation of the fixing device 10 according to an embodiment of the present invention.

Before warming-up the fixing roller 14 at a startup of the fixing device 10 (i.e., an initial state), the storage unit 3 including the electric double-layer capacitor having a large capacity is charged by the external power source through the main power supply unit 2. At the time of warming-up the fixing roller 14, the temperature of the fixing roller 14 is rapidly raised from a room temperature to a target temperature by supplying power to the main heating member 1*a* from the main power supply unit 2 and by supplying power to the auxiliary heating members 1*b* from the storage unit 3.

The present inventors carried out experiments under the following conditions:

(1) The fixing roller 14 made of aluminum has a diameter of about 40 mm and a thickness of about 0.7 mm;

(2) The power of about 1200 W is supplied to the main heating member 1 a from the main power supply unit 2 and the power of about 1700 W is supplied to the auxiliary heating members 1*b* from the storage unit 3. So, a total of about 2900 W power is supplied to the heating part 1 of the fixing roller 14.

According to the experimental results, when the fixing roller 14 was heated by supplying power only to the main heating member 1*a* from the main power supply unit 2, the temperature of the fixing roller 14 was raised from room temperature to a target temperature in about 30 seconds (i.e., a warm-up time). In contrast, when the fixing roller 14 was heated by supplying power to the heating part 1 from both the main power supply unit 2 and the storage unit 3, the warm-up time was reduced to about 10 seconds.

Because the storage unit 3 is constructed from a capacitor, the power supplied from the storage unit 3 to the auxiliary heating members 1*b* is gradually decreased from about 1700 W due to the decrease of voltage during supplying power to the auxiliary heating members 1*b*. With this characteristic of the capacitor, the power supplied from the storage unit 3 becomes small after a predetermined time has elapsed. Therefore, even if the temperature of the fixing roller 14 is raised to about 500 degrees centigrade at which the recording material P may ignite, the temperature of the fixing roller 14 gradually decreases due to the above-described characteristic of the capacitor. By using the capacitor as the storage unit 3, the temperature of the fixing roller 14 can be safely raised in a short period of time.

To secure safety, a safety device is provided in case that the system goes out of control. For example, the safety device may terminate the power supply by cutting off a power supply circuit with a safety circuit, such as a temperature fuse or a thermostat.

The supply of power to the heating part 1 can be increased by using two series of commercial power sources or by using a secondary battery or a fuel battery. However, in this case, a large amount of power is continuously supplied to the heating part 1, so that the warm-up time for raising the temperature of the fixing roller 14 to a target fixing temperature is reduced and the temperature elevation is sharper. In this condition, a safety circuit cannot follow the temperature elevation. When the safety circuit starts to operate, the temperature of the heating part 1 may get too high and cause a recording sheet to ignite. In contrast, in a configuration using a capacitor, even if the system goes out of control and the power supply is not stopped, the heating of the heating member is stopped after a predetermined amount of power stored in the capacitor is used up, and the temperature rise of the heating member is automatically stopped. Thus, the warm-up time for raising the temperature of the fixing roller 14 to a target fixing temperature can be safely reduced by using a capacitor as a power supply.

As the fixing roller 14 is a thin-layered roller, if the number of recording materials P passing through the nip part between the fixing roller 14 and the pressing roller 15 per unit time increases, the surface temperature of the fixing roller 14 typically decreases. However, in the fixing device 10 of the present embodiment, the surface temperature of the fixing roller 14 is prevented from dropping by supplying power to the auxiliary heating members 1*b* from the storage unit 3, in addition to the supply of power from the main power supply unit 2 to the main heating member 1*a* during a sheet passing operation, as shown in the time chart of FIG. 5. Thus, even if the image forming apparatus is a high-speed machine, the fixing device 10 can achieve a short warm-up time of the fixing roller 14 and can prevent an undesirable drop of the temperature of the fixing roller 14; during a sheet passing operation, while using the thin-layered fixing roller 14.

If only one of the auxiliary heating members 1*b* capable of providing a 700 W output is heated during the sheet passing operation, the heating part 1 of the fixing roller 14 may be supplied with a power output of about 500 W from the storage unit 3, in addition to the power from the main power supply unit 2 during the sheet passing operation. In this configuration, because the drop of the temperature of the fixing roller 14 after the sheet passage through the fixing device 10 can be prevented, the image forming apparatus according to the embodiment of the present invention can achieve a high-speed image formation, for example, 75 copies per a minute (CPM). In a background image forming apparatus using a thin-layered fixing roller without performing the power supply from a capacitor during a sheet passing operation, an image formation speed is about 60 CPM at most.

Both of the two auxiliary heating members 1*b* may be used during the sheet passing operation, or the heating part 1 of the fixing roller 14 may include only one auxiliary heating member 1*b*. Employing a plurality of (e.g., two) auxiliary heating members 1*b* and one of the auxiliary heating members 1*b* increases the supply of power and enhances temperature control performance.

As shown in the time chart of FIG. 5, after performing image forming operations (i.e., the sheet passing operation), the image forming apparatus is put into a stand-by state if a next image forming operation is not performed during a predetermined time interval. In the stand-by state, that is, a non-operation state of the image forming apparatus in which the fixing device 10 is not used, the charging of the storage unit 3 is performed. In the stand-by state, the main power supply unit 2 can afford to supply power to the storage unit 3, and the storage unit 3 formed from a capacitor is charged in several minutes. Therefore, the storage unit 3 can be quickly charged for a subsequent warming-up operation, so that a user need not wait for a long time until a next image forming operation becomes ready. The stand-by state of the image forming apparatus of this embodiment may employ any save-mode, such as an off-mode and a low power mode.

As described above, by using a capacitor as the storage unit 3 for heating the heating part 1 of the fixing device 10, an advantage which cannot be obtained from a secondary battery can be obtained.

Figure 6:
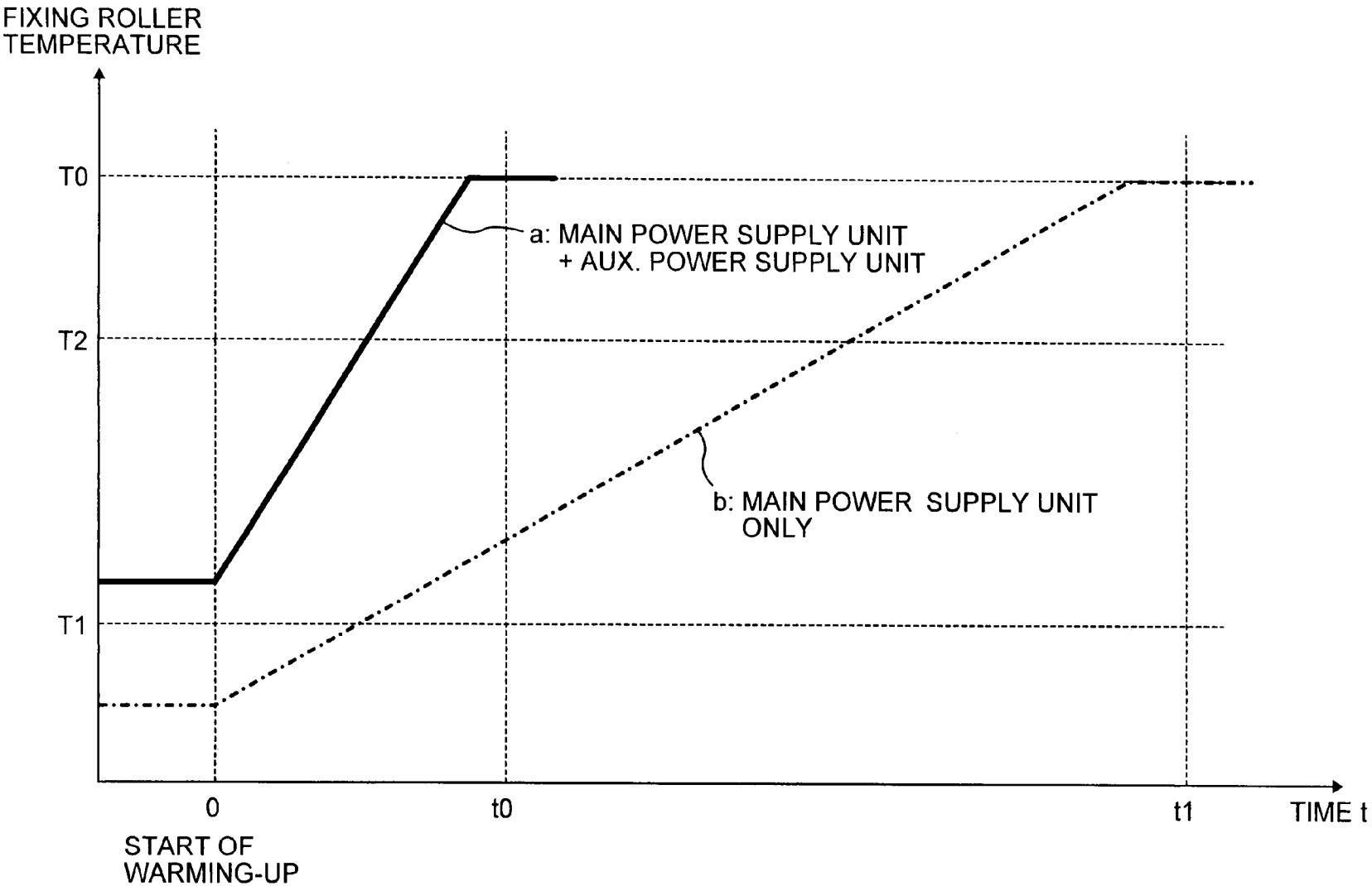
FIG. 6 is a graph showing the variation of the temperature of the fixing roller with time at the time of warming-up the fixing roller according to an embodiment of the present invention.

FIG. 6 is a graph showing the variation of the temperature of the fixing roller 14 with time at the time of warming-up the fixing roller 14 according to an embodiment of the present invention.

As shown by a line "a" (both the main power supply unit and the auxiliary power supply unit) of FIG. 6, when a local ambient temperature Ta detected by the local ambient temperature detecting unit 90 is a room temperature, for example, about 23 degrees centigrade, in a general office, the temperature of the fixing roller 14 rises to a target temperature "T0" by supplying power to the heating part 1 from both the main power supply unit 2 and the storage unit 3 in a target time "t0", for example, about 10 seconds.

In a low temperature condition in which the local ambient temperature Ta detected by the local ambient temperature detecting unit 90 is less than a low threshold temperature "T1", for example, about 15 degrees centigrade, the temperature T of the fixing roller 14 may be lower than the low threshold temperature "T1". This low temperature condition occurs when the fixing roller 14 is heated on a winter morning, for example. In this low temperature condition, as shown by a line "b" of FIG. 6, it takes time longer than the target time "t0" to raise the temperature of the fixing roller 14 to the target temperature "T0". In this case, the power supplying time of the storage unit 3 becomes relatively long and an amount of the consumed power of the storage unit 3 increases, so that the remaining amount of the stored power of the storage unit 3 to be used for supplying to the heating part 1 of the fixing roller 14 during the sheet passing operation decreases. In such a low temperature condition, the temperature of the recording material P is low as well, and the power greater than usual needs to be supplied to the heating part 1 during the sheet passing operation. However, the voltage of the storage unit 3 is lower than usual and the power supplied from the storage unit 3 becomes small. Consequently, a fixing failure typically occurs due to insufficient heating of the fixing roller 14.

So, if the local ambient temperature Ta detected by the local ambient temperature detecting unit 90 is lower than the low threshold temperature T1 before warming-up the fixing roller 14, the fixing roller 14 is warmed-up by using only the main power supply unit 2 without using the storage unit 3 or by using the main power supply unit 2 and using the storage unit 3 with its power supply reduced. By lowering power consumption at the time of warming-up the fixing roller 14 and by using the saved power of the storage unit 3 during the sheet passing operation, a fixing failure can be prevented even in a low temperature condition.

For example, in the case of using the auxiliary heating member 1*b* rated at 700 W at 100V, the voltage between terminals of the auxiliary heating member 1*b* decreases from 100V to 85V due to the power supply of the storage unit 3 at the time of warming-up the fixing roller 14, and the auxiliary heating member 1*b* provides about 500 W output during the sheet passing operation. If the storage unit 3 does not supply power to the auxiliary heating member 1*b* at the time of warming-up, the auxiliary heating member 1*b* can provide a 700 W output at the voltage of 100V during the sheet passing operation. In this condition, the fixing roller 14 can apply a sufficient amount of heat to the recording material P having a low temperature, and the power supplying time of the storage unit 3 can be extended during the sheet passing operation.

Usually, in an image forming apparatus, a fixing roller and a pressing roller are pre-rotated at the time of warming-up the fixing roller to obtain a predetermined fixing state even in the severest fixing low temperature condition which has been guaranteed in the model. When the recording material P having a toner image passes through the nip part between the fixing roller 14 and the pressing roller 15, the recording material P receives heat not only from the fixing roller 14 but also from the pressing roller 15 in the fixing device 10. Therefore, to make the temperatures of the fixing roller 14 and the pressing roller 15 uniform, these rollers are pre-rotated at the time of warming-up the fixing roller 14. By performing a pre-rotation of the fixing roller 14 and the pressing roller 15 at the time of warming-up, a fixing ability can be improved. However, because some amounts of heat of the fixing roller 14 are transferred to the pressing roller 15 during the pre-rotation of the fixing roller 14 and the pressing roller 15, the warm-up time for raising the temperature of the fixing roller 14 to a target temperature becomes longer.

Figure 7:
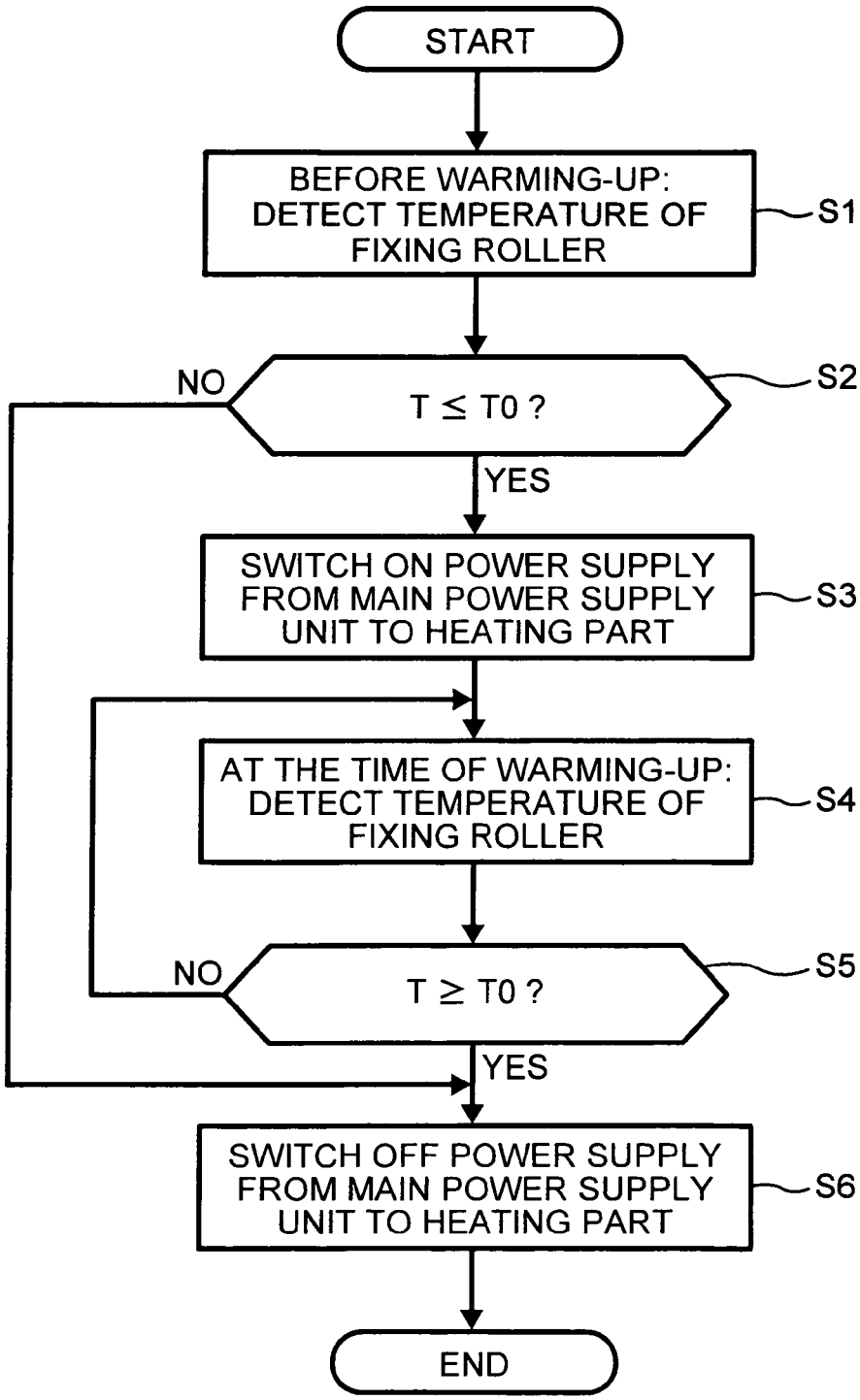
FIG. 7 is a flowchart of AC power supply control operation steps of a control unit at the time of warming-up the fixing roller according to an embodiment of the present invention.

FIG. 7 is a flowchart of AC power supply control operation steps of the control unit 60 at the time of warming-up the fixing roller 14 according to an embodiment of the present invention. First, the fixing temperature detecting unit 8 detects the temperature T of the fixing roller 14 before warming-up the fixing roller 14 in step S1. Then, the control unit 60 determines if the detected temperature T of the fixing roller 14 is less than or equal to the target temperature "T0" ($T \leqq T0$) in step S2. For example, the target temperature "T0" is set about 180 degrees centigrade. If the answer is NO in step S2, the control operation proceeds to step S6. In step S6, the control unit 60 switches OFF the power supply from the main power supply unit 2 to the main heating member 1*a*. If the answer is YES in step S2, the control unit 60 switches ON the power supply from the main power supply unit 2 to the main heating member 1*a* in step S3. Subsequently, the fixing temperature detecting unit 8 detects the temperature T of the fixing roller 14 during warming-up the fixing roller 14 in step S4. Then, the control unit 60 determines if the temperature T of the fixing roller 14 is greater than or equal to the target temperature "T0" ($T \geqq T0$) in step S5. If the answer is NO in step S5, the control operation returns to reexecute step S4. If the answer is YES in step S5, the control unit 60 switches OFF the power supply from the main power supply unit 2 to the main heating member 1*a* in step S6.

Figure 8:
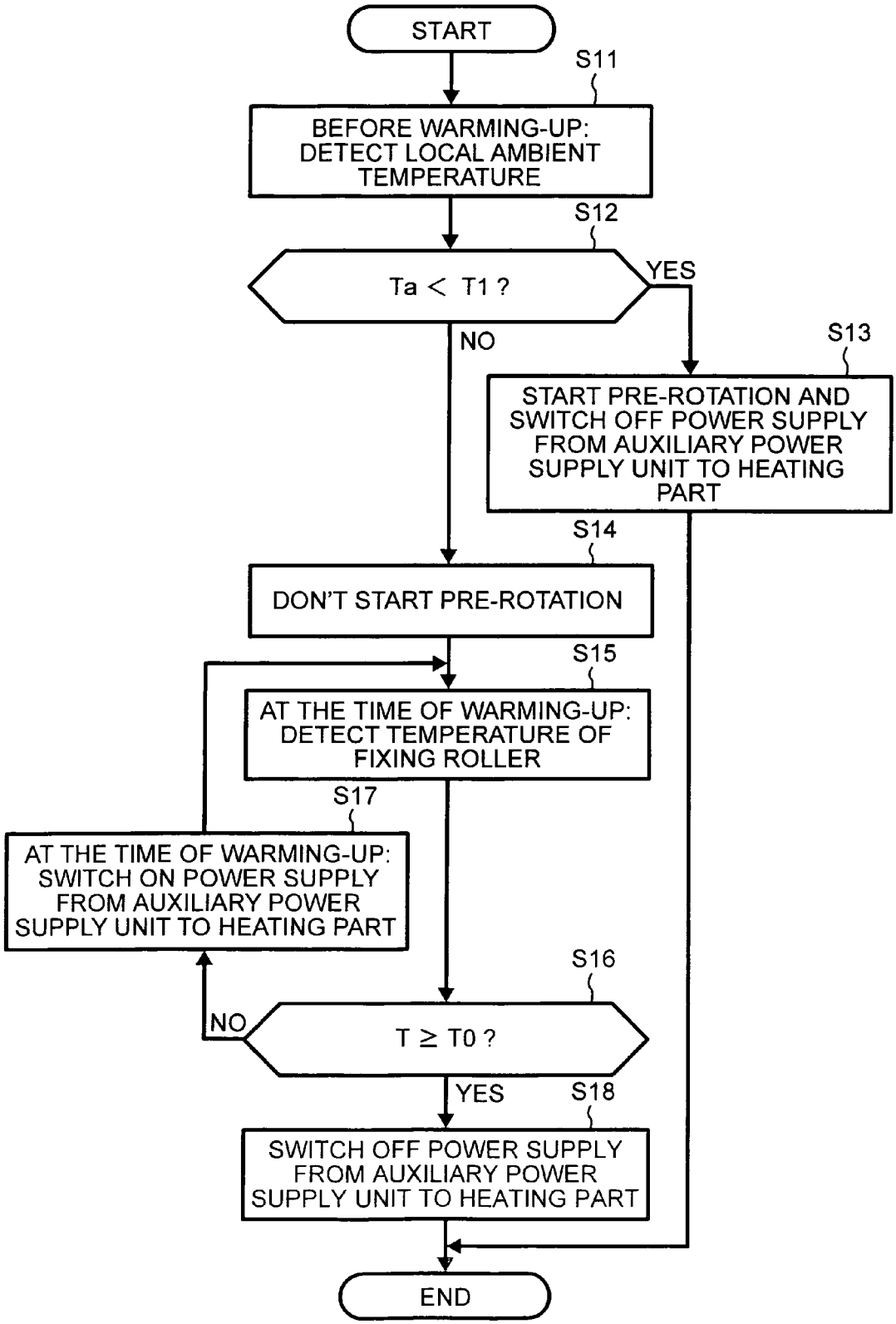
FIG. 8 is a flowchart of DC power supply control operation steps of the control unit at the time of warming-up the fixing roller according to an embodiment of the present invention.

FIG. 8 is a flowchart of DC power supply control operation steps of the control unit 60 at the time of warming-up the fixing roller 14 according to an embodiment of the present invention. First, the local ambient temperature detecting unit 90 detects a local ambient temperature Ta before warming-up the fixing roller 14 in step S11. Then, the control unit 60 determines if the detected local ambient temperature Ta is less than the low threshold temperature "T1" ($Ta<T1$) in step S12. For example, the low threshold temperature "T1" is set about 15 degrees centigrade. If the answer is YES in step S12, the control unit 60 controls the fixing roller 14 and the pressing roller 15 to start a pre-rotation, and switches OFF the power supply from the storage unit 3 to the auxiliary heating members 1*b* at the time of warming-up the fixing roller 14 in step S13. In step S13, the fixing roller 14 and the pressing roller 15 are pre-rotated to improve a fixing ability in the low temperature condition. However, the warm-up time for raising the temperature of the fixing roller 14 to the target temperature "T0" becomes longer. Further, as the local ambient temperature is low, the fixing roller 14 cannot be rapidly warmed-up even if the storage unit 3 is used. The line "b" of FIG. 6 indicates this low temperature condition. So, in such a case where the fixing roller 14 cannot be rapidly warmed-up to the target temperature "T0" even if the storage unit 3 is used, the power supply from the storage unit 3 to the auxiliary heating member 1*b* is cut off or may be reduced at the time of warming-up the fixing roller 14. By eliminating or lowering power consumption of the storage unit 3 at the time of warming-up the fixing roller 14 and by using the saved power of the storage unit 3 during the sheet passing operation, a fixing failure can be prevented even in a low temperature condition. Then, the control operation ends.

If the answer is NO in step S12, it is assumed that the fixing device 10 is in a high temperature condition. Therefore, it is assumed that the temperature of the fixing roller 14 can be raised to the target temperature "T0" within the target time "t0" by supplying power from the storage unit 3 to the heating part 1 in addition to the power supplied from the main power supply unit 2 to the heating part 1. The line "a" of FIG. 6 indicates this condition. Then, the control unit 60 determines not to control the fixing roller 14 and the pressing roller 15 to start a pre-rotation to warm up the fixing roller 14 rapidly in step S14. Further, the fixing temperature detecting unit 8 detects the temperature T of the fixing roller 14 in step S15 at the time of warming-up the fixing roller 14. Subsequently, the control unit 60 determines if the detected temperature T of the fixing roller 14 is greater than or equal to the target temperature "T0" (T≧T0) in step S16. For example, the target temperature "T0" is set about 180 degrees centigrade. If the answer is NO in step S16, the control unit 60 switches ON the power supply from the storage unit 3 to the auxiliary heating members 1*b* in step S17. Then, the control operation returns to reexecute step S15. If the answer is YES in step S16, the control unit 60 switches OFF the power supply from the storage unit 3 to the auxiliary heating members 1*b* in step S18.

Figure 9:
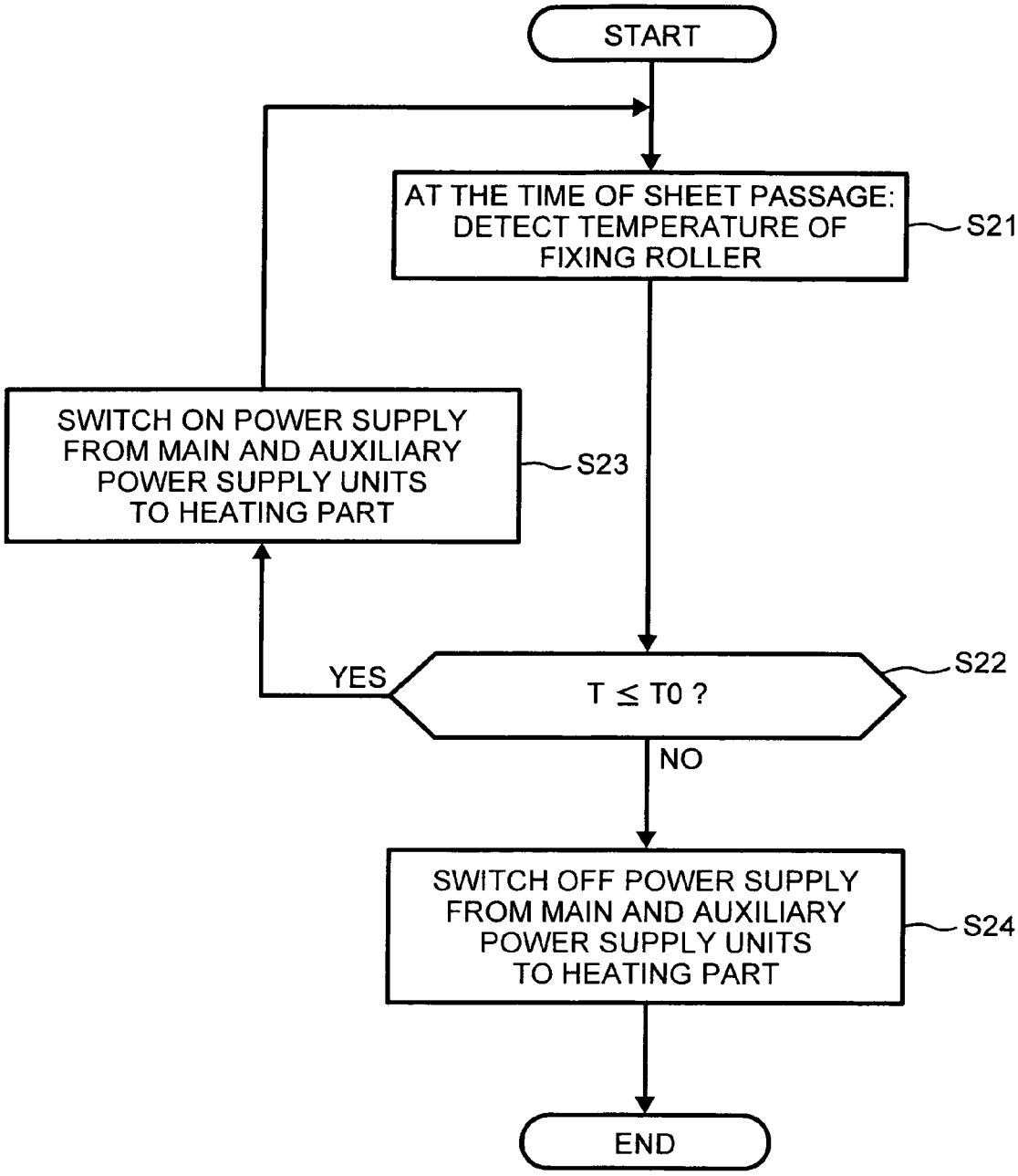
FIG. 9 is a flowchart of AC and DC power supply control operation steps of the control unit at the time of sheet passage according to an embodiment of the present invention.

FIG. 9 is a flowchart of AC and DC power supply control operation steps of the control unit 60 at the time of sheet passage according to an embodiment of the present invention. In this AC and DC power supply control operation, both AC power and DC power are supplied to the heating part 1 of the fixing roller 14 upon start of a sheet passing operation. After the completion of the sheet passing operation, the supply of the both AC power and DC power is stopped. Specifically, the fixing temperature detecting unit 8 detects the temperature T of the fixing roller 14 at the time of sheet passing operation in step S21. Subsequently, the control unit 60 determines if the temperature T of the fixing roller 14 is less than or equal to the target temperature "T0" (T≦T0) in step S22. If the answer is YES in step S22, the control unit 60 switches ON the power supply from the main power supply unit 2 and the storage unit 3 to the heating part 1 of the fixing roller 14 in step S23. Then, the control operation returns to reexecute step S21. If the answer is NO in step S22, the control unit 60 switches OFF the power supply from the main power supply unit 2 and the storage unit 3 to the heating part 1 of the fixing roller 14 in step S24.

Figure 10:
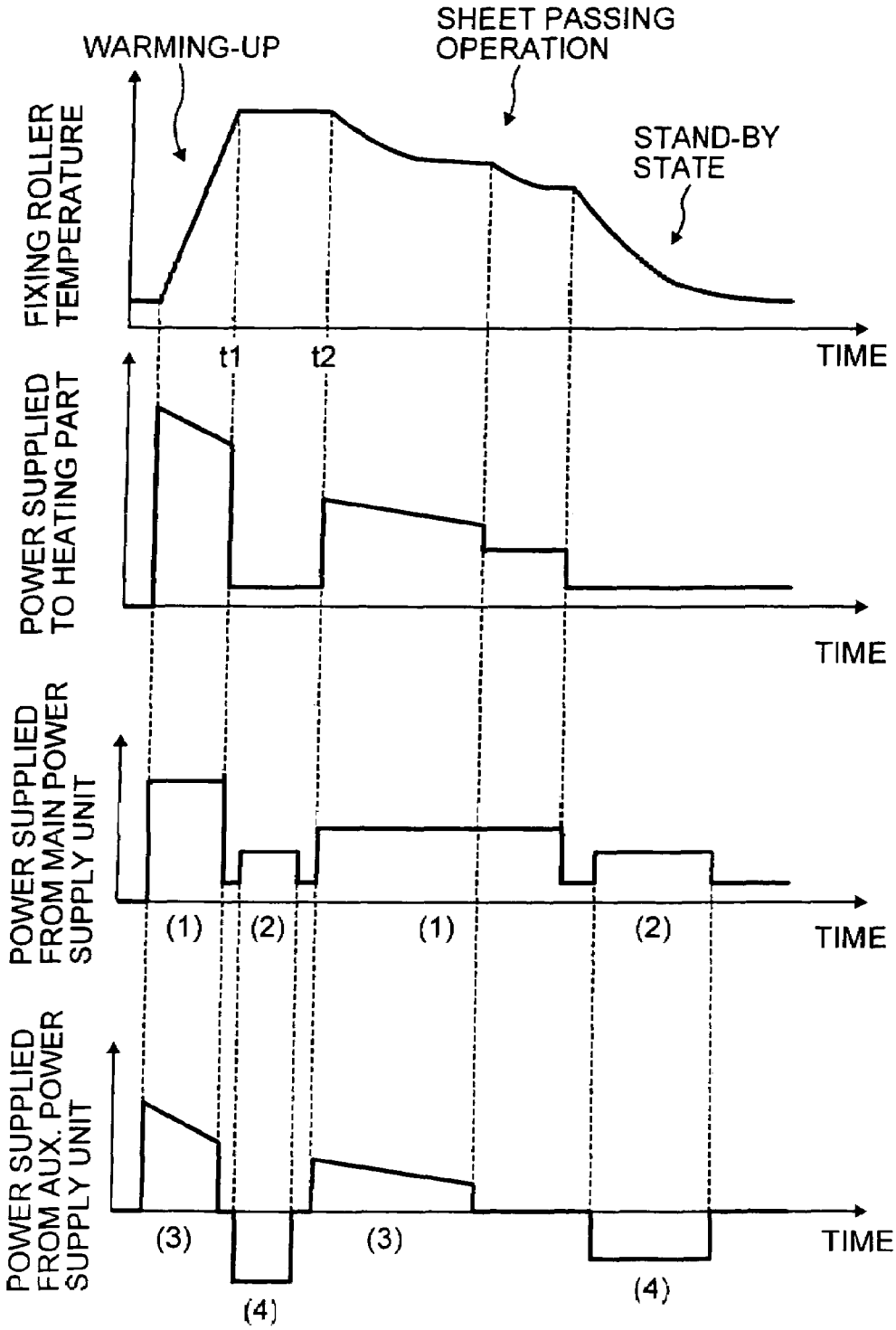
FIG. 10 is a time chart for explaining a power supply operation of the fixing device according to another embodiment of the present invention.

FIG. 10 is a time chart for explaining a power supply operation of the fixing device 10 according to another embodiment of the present invention. The time chart of FIG. 10 is similar to the time chart of FIG. 5 except that the storage unit 3 is charged by the main power supply unit 2 during a period from when the power supply from the storage unit 3 to the auxiliary heating members 1*b* is completed at the time of warming-up the fixing roller 14 (indicated by a reference character "t1" in FIG. 10) to when the power supply from the storage unit 3 to the auxiliary heating members 1*b* is started at the time of the sheet passing operation (indicated by a reference character "t2" in FIG. 10). Immediately after the temperature of the fixing roller 14 is raised to the target temperature "T0" in the warming-up operation, the remaining power of the storage unit 3 is reduced, so that the voltage of the storage unit 3 is lowered. In this condition, even if a halogen heater rated at the same power is used, the output of the power of the halogen heater decreases. So, in this embodiment, the storage unit 3 is charged by the main power supply unit 2 during a period between the "t1" and "t2" in which the power supplied from the main power supply unit 2 to the main heating member 1*a* is small. By charging the storage unit 3 in this period, the power supplied from the storage unit 3 to the heating part 1 of the fixing roller 14 can be increased at the time of sheet passing operation.

Figure 11:
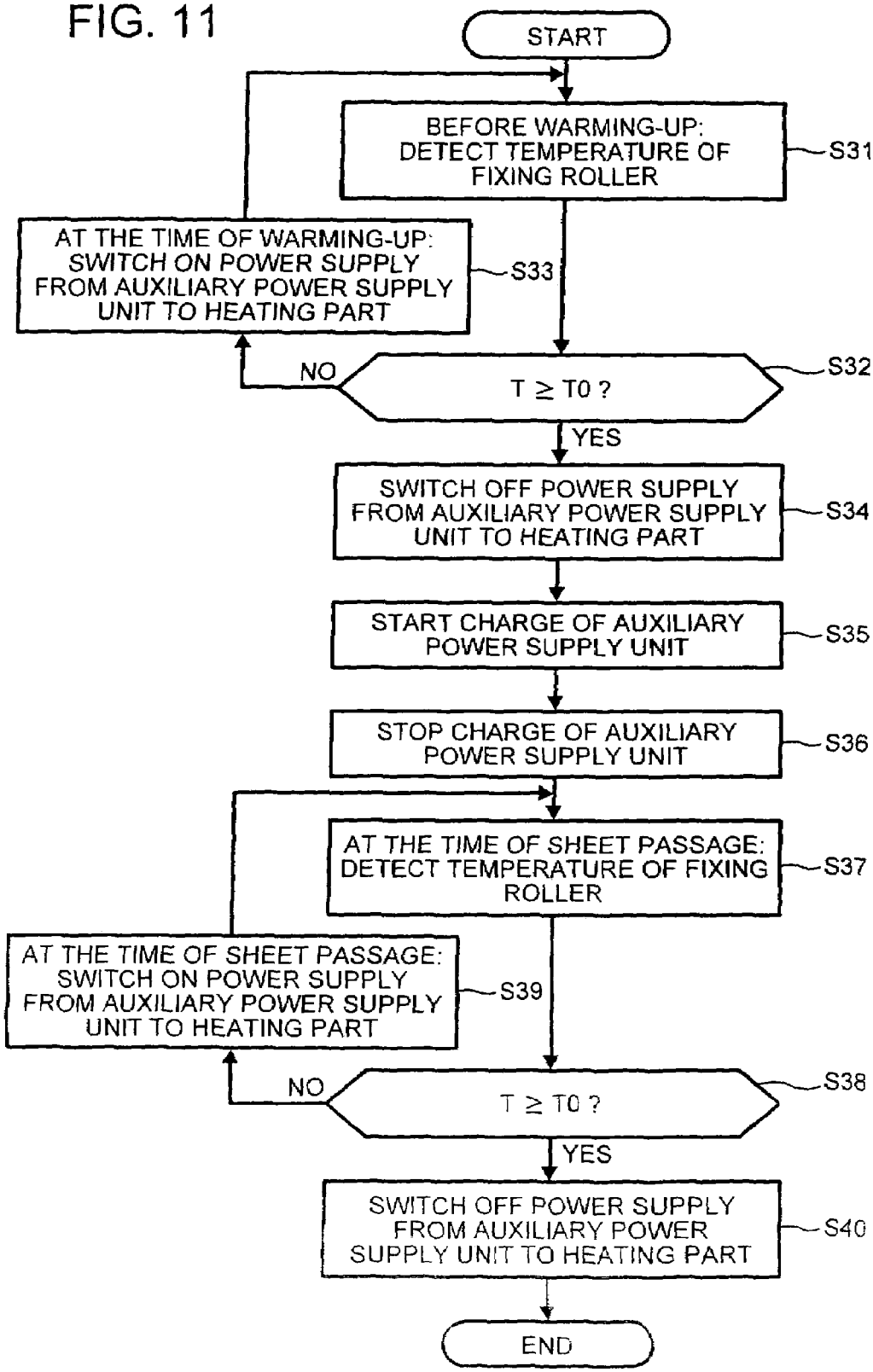
FIG. 11 is a flowchart of DC power supply control operation steps of the control unit at the time of warming-up the fixing roller according to another embodiment of the present invention.

FIG. 11 is a flowchart of DC power supply control operation steps of the control unit 60 at the time of warming-up the fixing roller 14 according to another embodiment of the present invention. First, the fixing temperature detecting unit 8 detects the temperature T of the fixing roller 14 before warming-up the fixing roller 14 in step S31. Then, the control unit 60 determines if the detected temperature T of the fixing roller 14 is greater than or equal to the target temperature T0 (T≧T0) in step S32. If the answer is NO in step S32, the control unit 60 switches ON the power supply from the storage unit 3 to the auxiliary heating members 1*b* at the time of warming-up the fixing roller 14 in step S33. By supplying power to the heating part 1 of the fixing roller 14 from the storage unit 3 at the warming-up time, the temperature of the fixing roller 14 can be raised to the target temperature "T0" in the target time "t0" as indicated by the graph "a" of FIG. 6. Then, the control operation returns to reexecute step S31.

If the answer is YES in step S32, the control unit 60 switches OFF the power supply from the storage unit 3 to the auxiliary heating members 1*b* in step S34. In this condition, as the initial temperature of the fixing roller 14 is high, the fixing roller 14 can be rapidly warmed-up without using the storage unit 3. Then, in step S35, the storage unit 3 starts to be charged from the main power supply unit 2 (from the commercial power source) through the charger 4 during a period between the time "t1" and "t2" in FIG. 10. When the voltage of the storage unit 3 reaches a predetermined value, charging of the storage unit 3 is stopped in step S36.

Subsequently, in step S37, the fixing temperature detecting unit 8 detects the temperature T of the fixing roller 14 at the time of sheet passage. Then, the control unit 60 determines if the temperature T of the fixing roller 14 is greater than or equal to the target temperature "T0" (T≧T0) in step S38. If the answer is NO in step S38, the control unit 60 switches ON the power supply from the storage unit 3 to the auxiliary heating members 1*b* in step S39. Then, the control operation returns to reexecute step S37. If the answer is YES in step S38, the control unit 60 switches OFF the power supply from the storage unit 3 to the auxiliary heating members 1*b* in step S40.

The present invention has been described with respect to the exemplary embodiments illustrated in the figures. However, the present invention is not limited to these embodiments and may be practiced otherwise.

In the above-described embodiments, the control unit 60 determines whether to pre-rotate the fixing roller 14 and the pressing roller 15 and whether to start to supply power from the storage unit 3 to the heating part 1 based on the local ambient temperature and the temperature of the fixing roller 14. Alternatively, the control unit 60 may determine whether to rotate the fixing roller 14 and the pressing roller 15 and whether to start to supply power from the storage unit 3 to the heating part 1 based on at least one of the local ambient temperature, the temperature of the fixing roller 14, and the temperature of the pressing roller 15. In this case, as illustrated in FIGS. 2 and 3, a temperature detecting unit 9 may be disposed in the fixing device 10. The temperature detecting unit 9 may be formed by any temperature detecting unit capable of detecting the surface temperature of the pressing roller 15, and the temperature detecting unit does not need to make direct contact with the outer circumferential surface of the pressing roller 15 as long as it can detect the surface temperature of the pressing roller 15. Therefore, various contact type sensors and non-contact type sensors, including a thermistor, a thermocouple, an infrared temperature detector, or the like, may be used for the temperature detecting unit 9. The temperature detecting unit 9 transmits data of temperature information to the control unit 60.

Numerous additional modifications and variations of the present invention are possible in light of the above teachings. It is therefore understood that within the scope of the appended claims, the present invention may be practiced other than as specifically described herein.

The invention claimed is:

1. A fixing device for fixing an image formed on a recording material, comprising:

a fixing member;

a heating part configured to heat the fixing member;

a pressing member configured to press-contact the fixing member, the fixing member and the pressing member being rotatable to pass the recording material having an image through a nip part formed between the fixing member and the pressing member, to thereby fix the image onto the recording material by heat and pressure;

a storage unit configured to be charged by an external power source to supply power to the heating part; and a control unit configured to control the external power source to supply power to the heating part, to determine whether to start to supply power to the heating part from the storage unit, and to select one of a first case and a second case at a time of warming-up the fixing member by the heating part, wherein the control unit is configured to control the external power source and the storage unit to supply power to the heating part without rotating the fixing member and the pressing member in the first case, and the control unit is configured to control the external power source to supply power to the heating part and to control the storage unit so as not to supply power to the heating part while rotating the fixing member and the pressing member in the second case.

2. The fixing device according to claim 1, further comprising:

a temperature detecting unit configured to detect at least one of a local ambient temperature in a vicinity of the fixing member, a temperature of the fixing member, and a temperature of the pressing member, wherein the control unit is configured to determine whether to rotate the fixing member and the pressing member based on the temperature detected by the temperature detecting unit at the time of warming-up the fixing member by the heating part.

3. The fixing device according to claim 1, wherein the control unit is configured to control the storage unit to supply power to the heating part when a plurality of recording materials consecutively pass through the nip part.

4. The fixing device according to claim 1, wherein the storage unit comprises an electric double layer capacitor.

5. A fixing device for fixing an image formed on a recording material, comprising:

a fixing member;

a heating part configured to heat the fixing member, the heating part including a first heating member and a second heating member;

a pressing member configured to press-contact the fixing member, the fixing member and the pressing member being rotatable to pass the recording material having an image through a nip part formed between the fixing member and the pressing member, to thereby fix the image onto the recording material by heat and pressure;

a main power supply unit connected to an external power source to supply power to the first heating member;

a storage unit acting as an auxiliary power supply unit configured to be charged by the external power source to supply power to the second heating member; and a control unit configured to control the external power source to supply power to the first heating member through the main power supply unit, to determine whether to start to supply power to the second heating member from the storage unit, and to select one of a first case and a second case at a time of warming-up the fixing member by the heating part, wherein the control unit is configured to control the main power supply unit and the storage unit to supply power to the first heating member and the second heating member, respectively, without rotating the fixing member and the pressing member in the first case, and the control unit is configured to control the main power supply unit to supply power to the first heating member and to control the storage unit so as not to supply power to the second heating member while rotating the fixing member and the pressing member in the second case.

6. A fixing device for fixing an image formed on a recording material, comprising:

a fixing member disposed on a recording material conveyance path;

a heating part configured to heat the fixing member to fix an image formed on the recording material by heat, the heating part including a first heating member and a second heating member;

a storage unit configured to be charged by an external power source to supply power to the second heating member;

a fixing temperature detecting unit configured to detect a temperature of the fixing member; and a control unit configured to control the external power source to supply power to the first heating member and to determine whether to start to supply power to the second heating member from the storage unit based on the temperature of the fixing member, at a time of warming-up the fixing member by the heating part, wherein the control unit is configured to control the external power source to charge the storage unit even if the external power source is under supply of power to the first heating member during a period from when power supply from the storage unit to the second heating member is completed at the time of warming-up the fixing member to when the power supply from the storage unit to the second heating member is started when a plurality of recording materials consecutively pass through the recording material conveyance path.

7. An image forming apparatus, comprising:

an image forming device configured to form an image on a recording material; and a fixing device configured to fix the image formed on the recording material, the fixing device comprising a fixing member, a heating part configured to heat the fixing member, a pressing member configured to press-contact the fixing member, the fixing member and the pressing member being rotatable to pass the recording material having an image through a nip part formed between the fixing member and the pressing member, to thereby fix the image onto the recording material by heat and pressure, a storage unit configured to be charged by an external power source to supply power to the heating part, and a control unit configured to control the external power source to supply power to the heating part, to determine whether to start to supply power to the heating part from the storage unit, and to select one of a first case and a second case at a time of warming-up the fixing member by the heating part, wherein the control unit is configured to control the external power source and the storage unit to supply power to the heating part without rotating the fixing member and the pressing member in the first case, and the control unit is configured to control the external power source to supply power to the heating part and to control the storage unit so as not to supply power to the heating part while rotating the fixing member and the pressing member in the second case.

8. The image forming apparatus according to claim 7, wherein the fixing device further comprises:

a temperature detecting unit configured to detect at least one of a local ambient temperature in a vicinity of the fixing member, a temperature of the fixing member, and a temperature of the pressing member, wherein the control unit is configured to determine whether to rotate the fixing member and the pressing member based on the temperature detected by the temperature detecting unit at the time of warming-up the fixing member by the heating part.

9. The image forming apparatus according to claim 7, wherein the control unit is configured to control the storage unit to supply power to the heating part when a plurality of recording materials consecutively pass through the nip part.

10. The image forming apparatus according to claim 7, wherein the storage unit comprises an electric double layer capacitor.

11. An image forming apparatus, comprising:

an image forming device configured to form an image on a recording material; and a fixing device configured to fix the image formed on the recording material, the fixing device comprising a fixing member, a heating part configured to heat the fixing member, the heating part including a first heating member and a second heating member, a pressing member configured to press-contact the fixing member, the fixing member and the pressing member being rotatable to pass the recording material having the image through a nip part formed between the fixing member and the pressing member, to thereby fix the image onto the recording material by heat and pressure, a main power supply unit connected to an external power source to supply power to the first heating member, a storage unit acting as an auxiliary power supply unit configured to be charged by the external power source to supply power to the second heating member, and a control unit configured to control the external power source to supply power to the first heating member through the main power supply unit, to determine whether to start to supply power to the second heating member from the storage unit, and to select one-of a first case and a second case at a time of warming-up the fixing member by the heating part, wherein the control unit is configured to control the main power supply unit and the storage unit to supply power to the first heating member and the second heating member, respectively, without rotating the fixing member and the pressing member in the first case, and the control unit is configured to control the main power supply unit to supply power to the first heating member and to control the storage unit so as not to supply power to the second heating member while rotating the fixing member and the pressing member in the second case.

12. An image forming apparatus, comprising:

an image forming device configured to form an image on a recording material; and a fixing device configured to fix the image formed on the recording material, the fixing device comprising a fixing member disposed on a recording material conveyance path, a heating part configured to heat the fixing member to fix an image formed on the recording material by heat, the heating part including a first heating member and a second heating member, a storage unit configured to be charged by an external power source to supply power to the second heating member, a fixing temperature detecting unit configured to detect a temperature of the fixing member, and a control unit configured to control the external power source to supply power to the first heating member through the main power supply unit and to determine whether to start to supply power to the second heating member from the storage unit based on the temperature of the fixing member, at a time of warming-up the fixing member by the heating part, wherein the control unit is configured to control the external power source to charge the storage unit even if the external power source is under supply of power to the first heating member during a period from when power supply from the storage unit to the second heating member is completed at the time of warming-up the fixing member to when the power supply from the storage unit to the second heating member is started when a plurality of recording materials consecutively pass through the recording material conveyance path.

13. A method of fixing an image formed on a recording material, comprising:

charging a storage unit by an external power source;

supplying power to a heating part from the storage unit;

heating a fixing member by the heating part;

controlling the external power source and the storage unit to supply power to the heating part without rotating the fixing member and a pressing member at a time of warming-up the fixing member by the heating part in a first case; and controlling the external power source to supply power to the heating part and controlling the storage unit so as not to supply power to the heating part while rotating the fixing member and the pressing member at the time of warming-up the fixing member by the heating part in a second case.

14. The method according to claim 13, further comprising:

detecting at least one of a local ambient temperature in a vicinity of the fixing member, a temperature of the fixing member, and a temperature of the pressing member; and determining whether to rotate the fixing member and the pressing member based on the detected temperature at the time of warming-up the fixing member by the heating part.

15. The method according to claim 13, further comprising:

controlling the storage unit to supply power to the heating part when a plurality of recording materials consecutively pass through a nip part formed between the fixing member and the pressing member.

16. A method of fixing an image formed on a recording material, comprising:

charging a storage unit by an external power source;

detecting a temperature of a fixing member;

supplying power to a heating part from the storage unit;

heating the fixing member by the heating part;

controlling the external power source to supply power to the heating part at a time of warming-up the fixing member by the heating part;

determining whether to start to supply power to the heating part from the storage unit based on the temperature of the fixing member at the time of warming-up the fixing member by the heating part; and controlling the external power source to charge the storage unit even if the external power source is under supply of power to the heating part during a period from when power supply from the storage unit to the heating part is completed at the time of warming-up the fixing member to when the power supply from the storage unit to the heating part is started when a plurality of recording materials consecutively pass through a recording material conveyance path on which the fixing member is disposed.

17. A fixing device for fixing an image formed on a recording material, comprising:

a fixing member;

a heating part configured to heat the fixing member, the heating part including a first heating member and a second heating member;

a pressing member configured to press-contact the fixing member, the fixing member and the pressing member being rotatable to pass the recording material having an image through a nip part formed between the fixing member and the pressing member, to thereby fix the image onto the recording material by heat and pressure;

first means for supplying power to the first heating member;

second means for supplying power to the second heating member, the second means for supplying being charged by an external power source;

means for controlling the first means for supplying and the second means for supplying to supply power to the first heating member and the second heating member, respectively, without rotating the fixing member and the pressing member at a time of warming-up the fixing member in a first case; and means for controlling the first means for supplying to supply power to the first heating member and for controlling the second means for supplying so as not to supply power to the second heating member while rotating the fixing member and the pressing member at the time of warming-up in a second case.

18. An image forming apparatus, comprising:

an image forming device configured to form an image on a recording material; and a fixing device configured to fix the image formed on the recording material, the fixing device comprising a fixing member disposed on a recording material conveyance path, a heating part configured to heat the fixing member to fix an image formed on the recording material by heat, the heating part including a first heating member and a second heating member, a fixing temperature detecting unit configured to detect a temperature of the fixing member, first means for supplying power to the first heating member, second means for supplying power to the second heating member, the second means for supplying being charged by an external power source, and means for controlling the external power source to supply power to the first heating member through the first means for supplying and for determining whether to start to supply power to the second heating member from the second means for supplying based on the temperature of the fixing member, at a time of warming-up the fixing member, wherein the means for controlling controls the external power source to charge the second means for supplying even if the external power source is under supply of power to the first heating member during a period from when power supply from the second means for supplying to the second heating member is completed at the time of warming-up the fixing member to when the power supply from the second means for supplying to the second heating member is started when a plurality of recording materials consecutively pass through the recording material conveyance path.

* * * * *